United States Patent [19]

Obst

[11] Patent Number: 5,005,752

[45] Date of Patent: Apr. 9, 1991

[54] APPLICATION APPARATUS

[75] Inventor: Frank Obst, Haan, Fed. Rep. of Germany

[73] Assignee: Stocko Metallwarenfabriken Henkels und Sohn GmbH & Co., Wuppertal, Fed. Rep. of Germany

[21] Appl. No.: 525,473

[22] Filed: May 18, 1990

[30] Foreign Application Priority Data

May 20, 1989 [DE] Fed. Rep. of Germany ..... 3916451

[51] Int. Cl.[5] ..... A41H 37/04

[52] U.S. Cl. ..... 227/114; 227/156

[58] Field of Search ..... 227/114, 115, 116, 117, 227/119, 156

[56] References Cited

U.S. PATENT DOCUMENTS

| | | | |
|---|---|---|---|
| 1,553,106 | 9/1925 | Purinton . | |
| 2,048,930 | 7/1936 | Hansen et al. | 227/114 X |
| 2,354,717 | 8/1944 | Treciokas . | |
| 2,936,454 | 5/1960 | Lundeberg | 227/114 X |
| 2,939,145 | 6/1960 | Lundeberg | 227/114 X |
| 3,381,871 | 5/1968 | Chalfin et al. . | |
| 4,606,487 | 8/1986 | Douri | 227/116 X |
| 4,923,099 | 5/1990 | Hasegawa et al. | 227/114 |

FOREIGN PATENT DOCUMENTS 0217192 9/1986 European Pat. Off. .

*Primary Examiner*—Paul A. Bell

*Attorney, Agent, or Firm*—Robert W. Becker & Associates

[57] ABSTRACT

An apparatus for applying small parts, such as ribets, eyelets, snaps, hooks, buttons, etc., to a carrier material is provided. In addition to having an applying tool, the apparatus includes a separating or sorting magazine for the storage of loose small parts. This magazine comprises a container that has a feed opening, as well as a working mechanism that is secured to the container and via which the small part are separated or sorted. In order to enable as easy emptying of the sorting magazine, the container and/or the working mechanism is pivotably mounted and hence the sorting magazine can be opened for emptying the same.

6 Claims, 1 Drawing Sheet

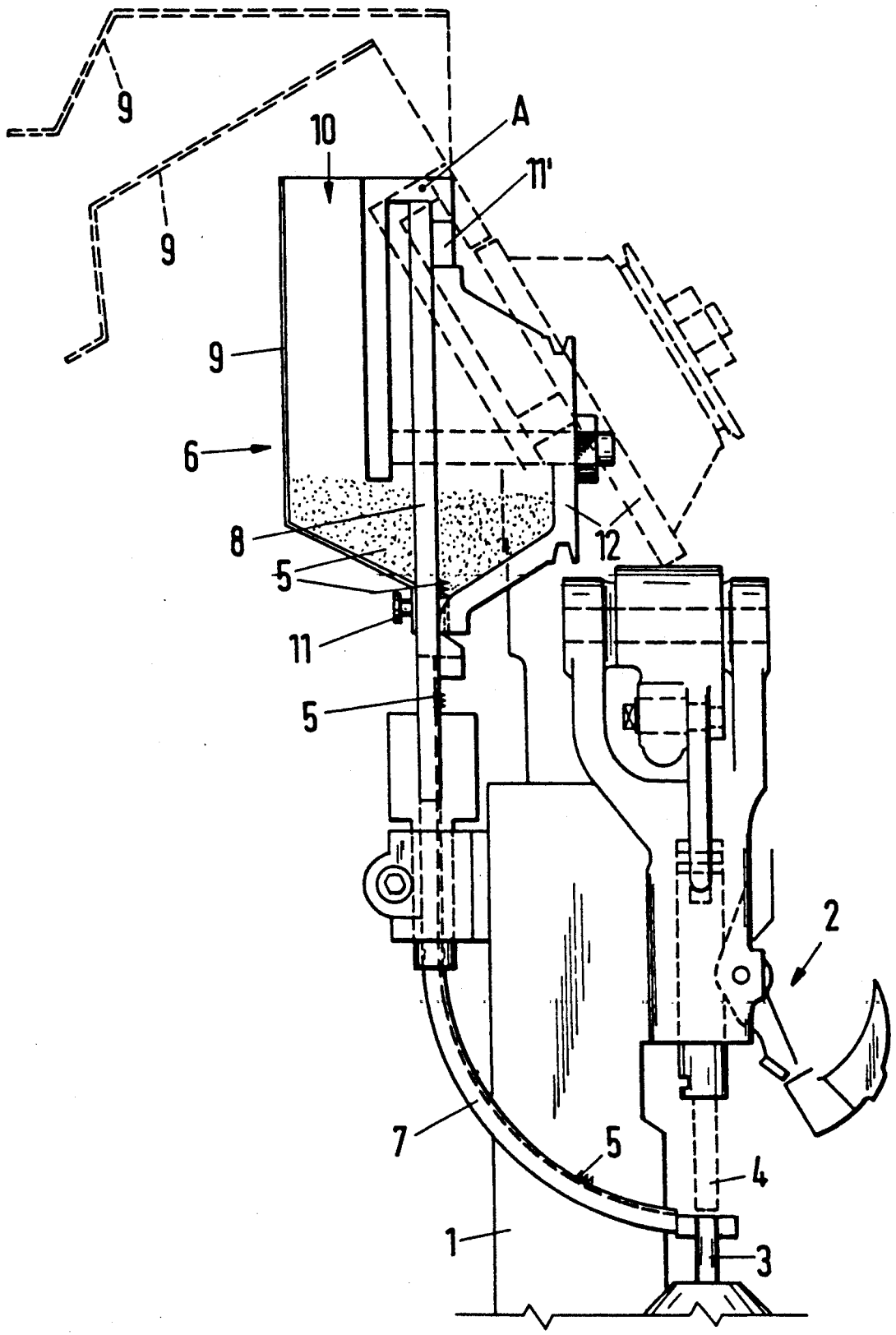
9
9
10
A
11'
9
6
8
5
11
5
12
2
7
5
4
1
3

APPLICATION APPARATUS

BACKGROUND OF THE INVENTION

The present invention relates to an apparatus for applying small parts, such as rivets, eyelets, snaps, hooks, buttons, etc., to a carrier material, and includes: a separating or sorting magazine for storing loose small parts, with the sorting magazine comprising a laterally open, tub-shaped container that has a feed opening for the small parts and also comprises, for sorting the small parts, a drum-like working mechanism that is secured to the side of the container; an applying tool; and a guide rail that is disposed between the sorting magazine and the applying tool for supplying oriented small parts that leave the sorting magazine.

Application machines of this general type are known. They serve for the application of small parts to a carrier material. Such small parts can, for example, be rivets, eyelets, snaps, hooks, buttons, etc. The heretofore known application apparatus basically comprise an applying tool that carries out the process of applying the small part to the carrier material. Since the parts that are to be applied are small parts, these parts are loosely stored in a magazine that is embodied as a separating or sorting magazine into which the small parts are loaded. The small parts are supplied from this sorting magazine to the applying tool via a guide rail after the small parts are separated and oriented within the sorting magazine For this purpose, the sorting magazine comprises a tubshaped container that is vertically inclined and therefore laterally opened. The top of the container is provided with a feed opening for the small parts. In the vicinity of the lateral opening of the container, a drum-like working mechanism is flanged onto the container; this working mechanism is driven by a motor and serves for the separation and sorting of the small parts. In so doing, the working mechanism supplies the small parts to the guide rail.

With the heretofore known application machines, the sorting magazine is self-contained for accommodating the small parts. This creates a problem if during the course of time so-called scrap, i.e. small parts that cannot leave the sorting magazine due to deformations and cannot be conveyed to the guide rail, accumulate in the sorting magazine, so that to alleviate this situation the sorting magazine must from time to time be emptied in order to remove scrap. For this purpose, with the heretofore known application machines the sorting magazine must be completely dismantled; this is very time intensive and expensive.

It is therefore an object of the present invention to improve the application apparatus of the aforementioned general type in such a way that it does not have to be disassembled in order to empty the sorting magazine.

BRIEF DESCRIPTION OF THE DRAWING

This object, and other objects and advantages of the present invention, will appear more clearly from the following specification in conjunction with the accompanying schematic drawing, which is an elevational view of one exemplary embodiment of the inventive apparatus for applying small parts to a carrier material.

SUMMARY OF THE INVENTION

The inventive application apparatus is characterized primarily in that the container and/or the working mechanism is pivotably mounted about a shaft to permit opening and emptying of the sorting magazine.

An application apparatus that is constructed pursuant to the inventive teaching has the advantage that an emptying of the sorting magazine is possible in an extremely straightforward technical manner. Regardless of where the sorting magazine is disposed on the machine, a complete emptying is always possible, whereby for this purpose it is merely necessary to swing out either the container or the working mechanism in order in this manner to open the sorting magazine. As a result, all of the small parts that are in the sorting magazine can be removed, without it being necessary to dismantle the magazine. Thus, a simple removal of the scrap that accumulates in the sorting magazine during the course of time is ensured.

Pursuant to one preferred specific embodiment of the sorting magazine, both the container as well as the working mechanism are pivotably mounted. As a result, it is possible to empty the magazine from both sides. As a result of this possibility of being able to empty the magazine from both sides, the magazine can be completely emptied in a rapid manner.

Where both the container and the working mechanism are pivotable, they are preferably mounted so as to be pivotable about a common shaft. This can be realized in a technically straightforward manner.

In one preferred specific embodiment, the shaft is disposed in the upper portion of the container and/or the working mechanism and extends horizontally. As a result of this arrangement of the shaft, the container as well as the working mechanism can be pivoted upwardly, so that the small parts that are in the sorting magazine can fall out downwardly.

In one structurally preferred specific embodiment, a frame structure having a through passage for the small parts is disposed between the container and the working mechanism; the container and/or the working mechanism is pivotably mounted on this frame structure. This represents a technically straightforward possibility for the pivotable mounting of the container and the working mechanism.

Finally, pursuant to a further specific embodiment it is proposed that screws be provided in order to fix the container and/or the working mechanism in the closed position of the sorting magazine. By means of these screws, which are in particular embodied as knurled-head screws, the operator of the application machine can easily open the sorting magazine for the emptying or removal process.

Further specific features of the present invention will be described in detail subsequently.

DESCRIPTION OF PREFERRED EMBODIMENTS

Referring now to the drawing in detail, the application machine comprises a support frame 1 on which is disposed an applying tool 2. This tool is constructed in a conventional manner, and in the illustrated embodiment comprises an anvil 3 as well as a stamper or ram 4 that can be moved upwardly and downwardly.

The small parts 5 that are to be used, for example rivets, eyelets, snaps, hooks, buttons, etc., are conveyed to the applying tool 2. In the illustrated embodiment, the small parts 5 are toothed rings. In this connection, the small parts 5 are stored in a separating or sorting magazine 6, at the lower end of which is disposed a guide rail 7 via which the small parts 5 that leave the sorting magazine 6 are conveyed to the applying tool 2; for this purpose, the lower region of the guide rail 7 is curved.

The sorting magazine 6 is provided with a frame structure 8; although not clearly recognizable from the drawing, the frame structure 8 has a central through passage. Disposed on one side of the frame structure 8 (the left side in the drawing) is a tub-shaped container 9, the upper end of which is provided with a feed opening 10 for the small parts 5; this feed opening 10 can additionally be provided with a (non-illustrated) funnel or hopper. The opening of the tub is in this connection disposed in the through passage of the frame structure 8, so that the small parts 5 on the other side of the frame structure 8 can pass through the passage. The container 9 is pivotably mounted about a horizontal shaft or axis A at the upper end of the frame structure 8 in such a way that the container can be pivoted upwardly, as indicated by dashed lines in the drawing. In this connection, the pivot angle is at the most 90°. in the closed position, the container 9 is fixed in position on the frame structure 8 of the sorting magazine 6 by means of a screw 11 that is in the form of a knurled-head screw.

Disposed on the other side of the frame structure 8 is a working mechanism 12 that is driven by a (non-illustrated) motor and serves to separate and sort the small parts 5 that are in the magazine 6. A conveying means supplies the separated small parts 5 to the guide rail 7. The function and operation of this working mechanism 12 is basically known per se. However, the special feature of the working mechanism 12 illustrated in the drawing is that it is also mounted in such a way as to be pivotable by a maximum of 90° about the axis A, with the pivoted position being indicated by dashed lines. Here also in the closed position the working mechanism 12 is fixed in position (see the solid-line representation) by means of a screw 11' that is similarly in the form of a knurled-head screw.

The pivotable mounting of both the container 9 as well as the working mechanism 12 of the sorting magazine 6 has the advantage that the small parts 5 can be easily removed from the sorting magazine 6 if, for example during the course of time, socalled scrap has accumulated that cannot be used or processed. To remove the small parts 5, after the screws 11, 11' have been loosened, it is merely necessary to pivot the container 9 and the working mechanism 12 upwardly, so that the small parts 5 disposed therein fall down and out. After the container 9 and the working mechanism 12 have been pivoted back, and the screws 11, 11' have been tightened, small parts 5 can again be fed to the separating or sorting magazine 6.

A further advantage of the inventively embodied sorting magazine 6 is the symmetrical construction. This means that all of the parts can be used both on the left side as well as the right side, so that uniform components are obtained for both sides.

The present invention is, of course, in no way restricted to the specific disclosure of the specification and drawing, but also encompasses any modifications within the scope of the appended claims.

What I claim is:

1. In an apparatus for applying small parts, such as rivets, eyelets, snaps, hooks, buttons, etc., to a carrier material, and including: a separating or sorting magazine for storing loose small parts, with said magazine comprising a laterally open, tub-shaped container that has a feed opening for said small parts and also comprising, for sorting said small parts, a drum-like working mechanism that is secured to a side of said container; an applying tool: and a guide rail that is disposed between said magazine and said applying tool for supplying oriented small parts that leave said magazine, the improvement wherein:

at least one of said container and said working mechanism is pivotably mounted about a shaft to permit opening and emptying of said magazine.

2. An application apparatus according to claim 1, in which both said container and said working mechanism are pivotably mounted 3. An application apparatus according to claim 2, in which said container and said working mechanism are pivotable about a common shaft.

4. An application apparatus according to claim 1, in which said shaft extends horizontally in an upper region of said container and/or said working mechanism.

5. An application apparatus according to claim 1, in which a frame structure having a through passage for said small parts is disposed between said container and said working mechanism, with said container and/or said working mechanism being pivotably mounted on said frame structure.

6. An application apparatus according to claim 1, in which screw means are provided for fixing said container and/or said working mechanism in a closed position of said sorting magazine.

* * * * *